United States Patent [19]

Marcus

[11] Patent Number: 4,759,289

[45] Date of Patent: Jul. 26, 1988

[54] BEARING FOR INK TRANSFER ROLLERS

[76] Inventor: Joel Marcus, 68-61 Yellowstone Blvd., Forest Hills, N.Y. 11375

[21] Appl. No.: 553,536

[22] Filed: Nov. 21, 1983

[51] Int. Cl.[4] ..... B41F 1/46

[52] U.S. Cl. ..... 101/348; 101/DIG. 14

[58] Field of Search ..... 101/348, 335, 367, 350, 101/359, DIG. 14; 308/908; 384/908, 276, 300, 391

[56] References Cited

U.S. PATENT DOCUMENTS

| | | | |
|---|---|---|---|
| 3,193,335 | 7/1965 | Wing | 384/300 X |
| 3,481,277 | 12/1969 | Pettibone | 384/276 X |
| 3,815,498 | 6/1974 | Harrod | 101/348 |
| 4,076,453 | 2/1978 | Feroy | 384/276 X |
| 4,337,699 | 7/1982 | Beisel | 101/348 |

FOREIGN PATENT DOCUMENTS

| | | | |
|---|---|---|---|
| 2931141 | 2/1981 | Fed. Rep. of Germany | 101/348 |
| 695195 | 8/1953 | United Kingdom | 384/908 |

*Primary Examiner*—Charles A. Pearson
*Assistant Examiner*—Moshe I. Cohen
*Attorney, Agent, or Firm*—Charles E. Temko

[57] ABSTRACT

A synthetic resinous bearing having hydrophobic properties which continuously expel collected waste ink from an ink transfer roller of a printing press. The bearing consists of a molded sleeve of synthetic resinous material such as sintered Teflon or molded nylon which has been impregnated with a compatiable lubricant such as molybdenum disulfide or the like. The bearing includes longitudinally oriented grooves on an inner surface thereof which are not wetted by the flow of waste ink and contaminants, and which provide for continuous discharge of the same during operation of the associated printing press.

3 Claims, 1 Drawing Sheet

BEARING FOR INK TRANSFER ROLLERS

BACKGROUND OF THE INVENTION

This invention relates generally to the field of printing presses, and more particularly to an improved bearing for supporting ink transfer rollers in which the useful life thereof has been substantially extended and the cost of manufacture significantly reduced.

In the construction of high speed printing presses such as those used in the newspaper industry, there are normally present one or more so-called ink transfer rollers used to transfer ink from an inked roller to an impression roller which then applies the ink in a predetermined pattern to a web of paper. In such presses, the roller is normally the width of the printed web, and of effective diameter slightly more than four inches. In operation, the roller executes not only rotational motion about the principal axis thereof, but, under the influence of a camming guide, it also executes axially oriented reciprocation over a path of travel of several inches. The roller operates in an atmosphere of fluid printing ink, water, and a surfactant which is continuously coated on the outer surface thereof, and substantially removed during transfer. Excess ink and contaminants continuously flow from the ends of the roller, and a substantial amount collects on the metal shaft which forms the core of the roller. In printing presses in use in the newspaper field, the roller is supported by journaling the shaft in roller bearings which permit not only rotation but the reciprocation abovementioned. As the printing ink contains carbon black and other solid particles flowing into the bearing with each reciprocating movement, an obvious effect is the shortening of the useful life of the bearing to as little as several weeks of continuous operation. While the cost of replacement bearings is not normally large, the cost of replacement includes the labor of at least partially disassembling and reassembling the press, and the downtime which is lost from the standpoint of production. In bearings of the type used in such apparatus, it is not possible to employ seals which are adapted to prevent the ink flow, and the bearing must provide a draining function as well as the normal support function. In commonly used roller type bearings the waste ink does not provide a lubricant, but an abrasive which causes the rollers to wear at a relatively high rate. Where lubrication is originally provided, the ink tends to wash this lubrication away as it flows through the bearing.

SUMMARY OF THE INVENTION

Briefly stated, the invention contemplates the provision of an improved synthetic resinous bearing presenting a normally hydrophobic surface to the end portions of the roller shaft, there being longitudinal grooves extending the entire length of the bearing to provide means for conducting the waste ink outwards of the bearings at both ends of the shaft, as well as preventing accumulation of the waste ink within the bearing. As the bearing surfaces have no affinity for the water based ink, the flow is unimpeded, and little or no ink becomes disposed between the bearing surface and the surface of the roller shaft. While a variety of synthetic resinous materials may be used in the fabrication of the bearing, sintered Teflon and nylon which has been impregnated with molybdenum disulfide has been found to be particularly suitable.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
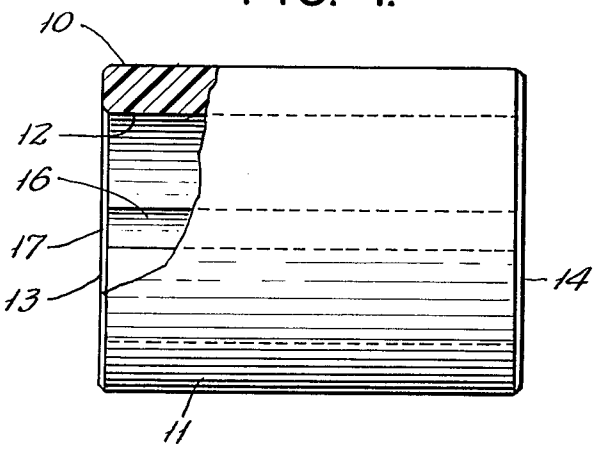
FIG. 1 is a side elevational view of a bearing embodying the invention.
Figure 2:
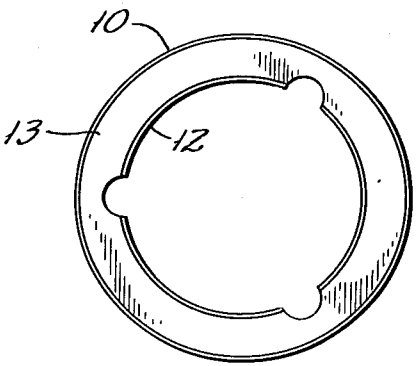
FIG. 2 is an end elevational view thereof.

In accordance with the invention, the device, generally indicated by reference character 10, is of molded synthetic resinous material, and is bounded by a cylindrical outer surface 11, a cylindrical inner surface 12, and first and second end surfaces 13 and 14, respectively. A plurality of longitudinal grooves 15 of generally semicircular cross section extend between the end surfaces 13 and 14. The grooves are bounded by semicircular surfaces 16 and end edges 17 lying in the curved plane of the inner cylindrical surface 12.

Figure 3:
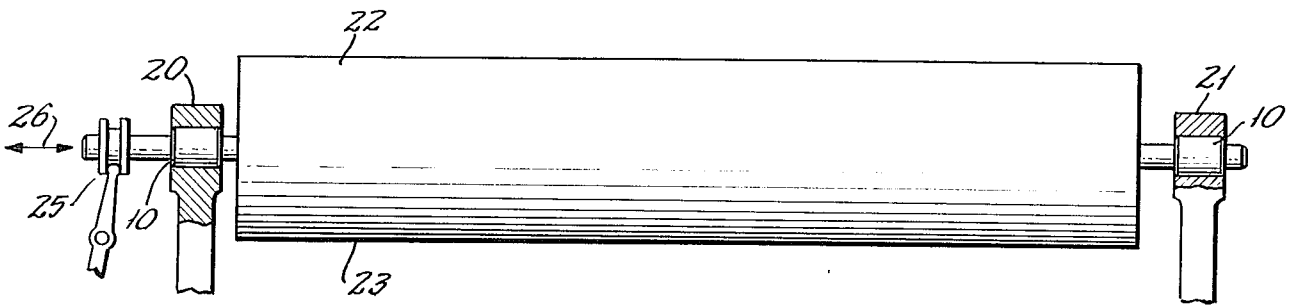
FIG. 3 is a side elevational view showing a pair of bearings embodying the invention in installed condition supporting a printing press ink transfer roller.

Referring to FIG. 3, a pair of devices 10 are mounted within journals 20 and 21 to support a printing press transfer roller 22 of known type. The roller 22 includes an outer rubber surface 23 and is supported on an elongated polished metallic shaft 24 supported on the inner surfaces 12 of the bearings 10. The shaft mounts the camming guide 25 which, under the influence of means not shown, reciprocates the shaft 24 in the directions indicated by the arrow 26 as the shaft rotates during operation.

The roller 12 receives ink from an inked roller (not shown), and transfers the ink in predetermined pattern either directly or indirectly to an impression cylinder (not shown). During the course of transfer, received ink is substantially entirely transferred, but small amounts of ink accumulate on the transfer roller and migrate to the ends thereof where ultimately the same drips upon the shaft 24 to migrate to the supporting bearings.

Where conventional roller bearings have been employed, this flow passes through the bearings where the ink serves as an abrasive, with a resultant shortening of the useful life of the bearing. Where the bearing has been previously packed with mineral type lubricant, the water based ink tends to emulsify the lubricant and ultimately washes it away.

So-called plain bearings are also known in the art, and have been widely used for supporting rotating shafts. However, such bearings require soft metal linings, such as babbit, as well as a continuous supply of lubrication which is not practical in the instant environs.

My invention essentially provides a plain type bearing, which because of the materials from which it is made is essentially hydrophobic, so that the continuously flowing waste ink does not enter between the bearing surfaces and the shaft surfaces to cause abrasion. By providing at least one longitudinal groove, and preferably plural grooves, the edges which form the side boundaries of the grooves serve as a wiping means to prevent the waste ink from flowing between the bearing surface and the shaft surface. As a result, the bearing runs in a substantially dry state.

Two materials have been found to be particularly suitable for the contemplated purpose. Teflon, being essentially a sitered material, is self-lubricating. If molybdenum disulfide impregnated nylon is used, the result is equally satisfactory.

I am aware that it has been known in the art to provide bearings of various materials in which the inner bearing surface has a transversely or longitudinally extending groove for the purpose of providing lubrication to the shaft surface. However, to the best of my knowledge, such bearings have not been manufactured from inherently hydrophobic materials, so that they would not perform in the above described manner.

I wish it to be understood that I do not consider the invention limited to the precise details of structure shown and set forth in this specification, for obvious modifications will occur to those skilled in the art to which the invention pertains.

I claim:

1. In a printing press having at least one ink transfer roller, said roller being mounted upon a shaft journaled between a pair of bearings for simultaneous rotational movement about a longitudinal axis of said shaft and reciprocating movement parallel to said shaft axis, said ink transfer roller during operation continuously depositing a quantity of waste printing ink upon said shaft in the area of said bearings which under said reciprocating movement migrates to said bearing, the improvement comprising: said bearing being formed of a hydrophobic synthetic resinous material and including at least one longitudinally extending groove communicating with a shaft bearing surface thereof for reception and conduction of said waste ink through said bearing to exit laterally outwardly therefrom; said groove being longitudinally bounded by a pair of edges which lie in the curved plane of said shaft bearing surface, at least one of said edges performing a wiping function upon the surface of said shaft disposed within said bearing, depending upon the direction of rotation of said shaft.

2. The improvements set forth in claim 1, in which said bearings are formed from sintered Teflon.

3. The improvements set forth in claim 1, in which said bearings are formed from molybdenum disulfide impregnated nylon.

* * * * *